United States Patent [19]

Alter

[11] 4,286,536

[45] Sep. 1, 1981

[54] REMOVABLE RUDDER ASSEMBLY

[75] Inventor: Hobart L. Alter, Capistrano Beach, Calif.

[73] Assignee: Coast Catamaran Corporation, Oceanside, Calif.

[21] Appl. No.: 63,966

[22] Filed: Aug. 6, 1979

[51] Int. Cl.[3] ..... B63H 25/06

[52] U.S. Cl. ..... 114/165

[58] Field of Search ..... 114/128, 130, 132, 162, 114/164, 165, 166, 39; 9/2 R, 2 S, 310 R, 310 A, 310 E

[56] References Cited

U.S. PATENT DOCUMENTS

| | | | |
|---|---|---|---|
| 1,206,368 | 11/1916 | Piazze | 114/165 |
| 2,386,803 | 10/1945 | Jutte | 114/162 |
| 3,946,693 | 3/1976 | Brown | 114/162 |

*Primary Examiner*—Trygve M. Blix
*Assistant Examiner*—Jesus D. Sotelo

[57] ABSTRACT

A removable rudder assembly for a boat includes a generally key-hole shaped rudder lock member which is adapted to fit into a key-hole shaped slot in the keel of the boat adjacent the stern. A rudder shaft extends through the rudder lock member, and a rudder is mounted on the rudder shaft. A tiller is removably attached to the upper end of the rudder shaft. The rudder assembly is removed from the boat by detaching the tiller, removing the rudder lock member from the slot, and withdrawing the shaft rearwardly from the slot.

10 Claims, 10 Drawing Figures

15
16
17
18
20
21
23
25
29
30
31
32
33
38
40
41
42
43
44

REMOVABLE RUDDER ASSEMBLY

BACKGROUND AND SUMMARY

This invention relates to a removable rudder assembly for boats.

The rudder of a boat, particularly a sailboat, often extends downwardly below the keel a substantial distance. Accordingly, it is often desirable to remove the rudder, for example, when trailering the boat to or from the water or when simply storing the boat.

U.S. Pat. No. 1,206,368 describes a removable rudder which can be withdrawn upwardly through a key-hole shaped metal rudder case which extends between the keel and deck of a boat. However, the size of the rudder is limited by the size of the key hole in the rudder case through which the rudder is withdrawn. The top of the key hole is closed by caps which are bolted together, and the caps must be removed before the rudder can be removed. Further, the metal rudder case which extends between the keel and the deck provides additional expense and weight.

U.S. Pat. No. 3,946,693 discloses a removable rudder which can be raised through a hollow housing which extends between the keel and deck. Again, the size of the rudder is limited by the size of the slot in the housing. The rudder is held in place by a wedge, and the rudder shaft therefore extends at an angle to the vertical.

The invention provides for rapid and easy removal of a rudder which is not limited in size to the opening through the keel. The opening extends aft to the stern, and the rudder is withdrawn rearwardly through the slot. The rudder is releasably locked in place by a removable rudder lock member which fits into the opening in the keel, and the upper end of the rudder shaft terminates adjacent the deck and is releasably attached to the tiller, which extends through an opening in the deck. The rudder can be removed merely by detaching the tiller from the rudder shaft and lifting the rudder lock member from the slot.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3:
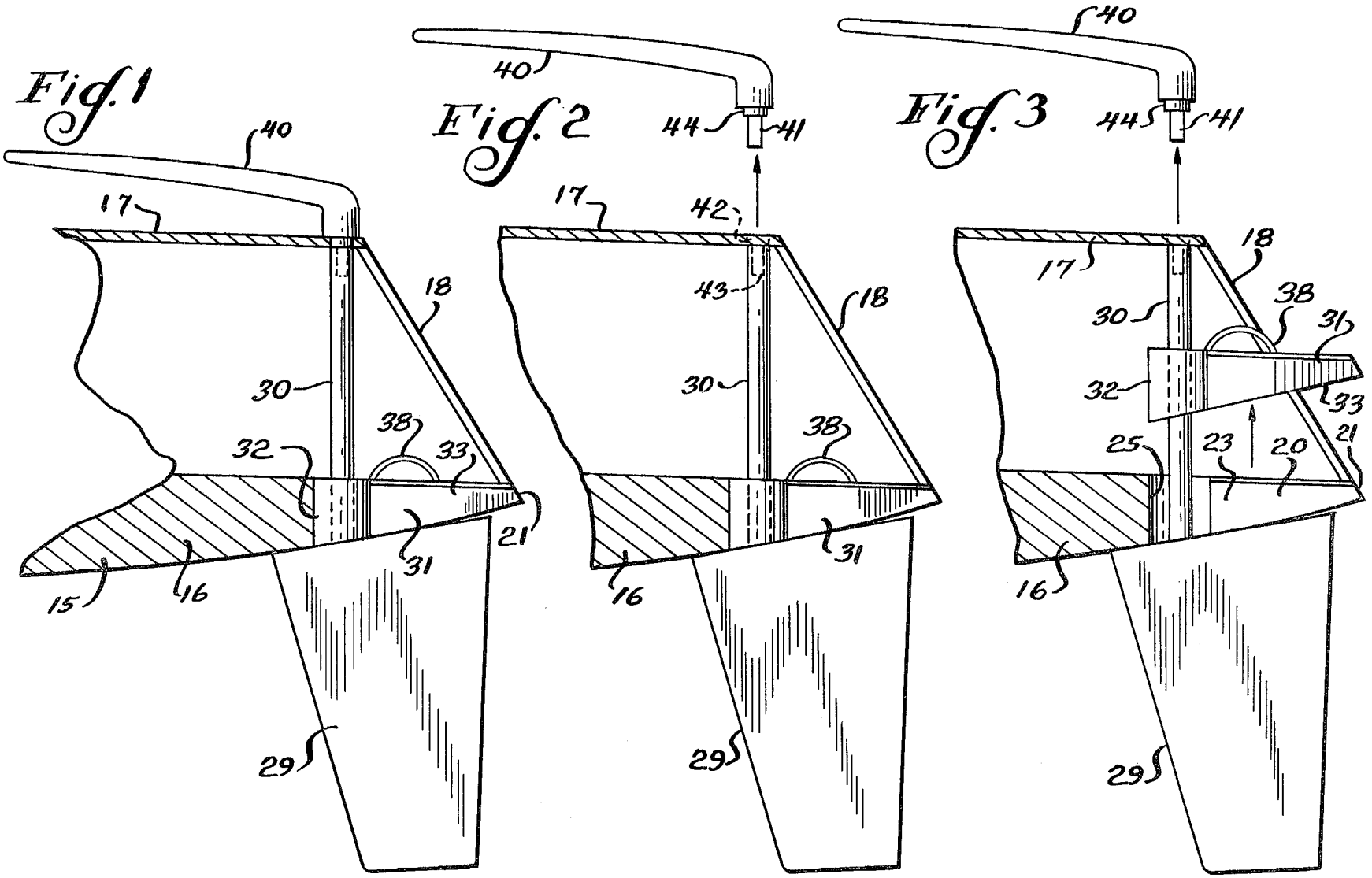
FIG. 1 is a fragmentary perspective view of the stern of a boat which is equipped with a removable rudder assembly in accordance with the invention.
FIG. 2 is a view similar to FIG. 1 showing the tiller being detached from the rudder shaft.
FIG. 3 is a view similar to FIGS. 1 and 2 showing the rudder lock member being raised from the slot in the keel.

A boat 15 includes a hull having a keel 16, a deck 17, and a transom 18. The transom has an opening 19 (see FIG. 5) to provide access to the interior of the hull, and the opening can be closed by a door or panel (not shown).

Figures 4, 5, 6, 7, 8, 9, 10:
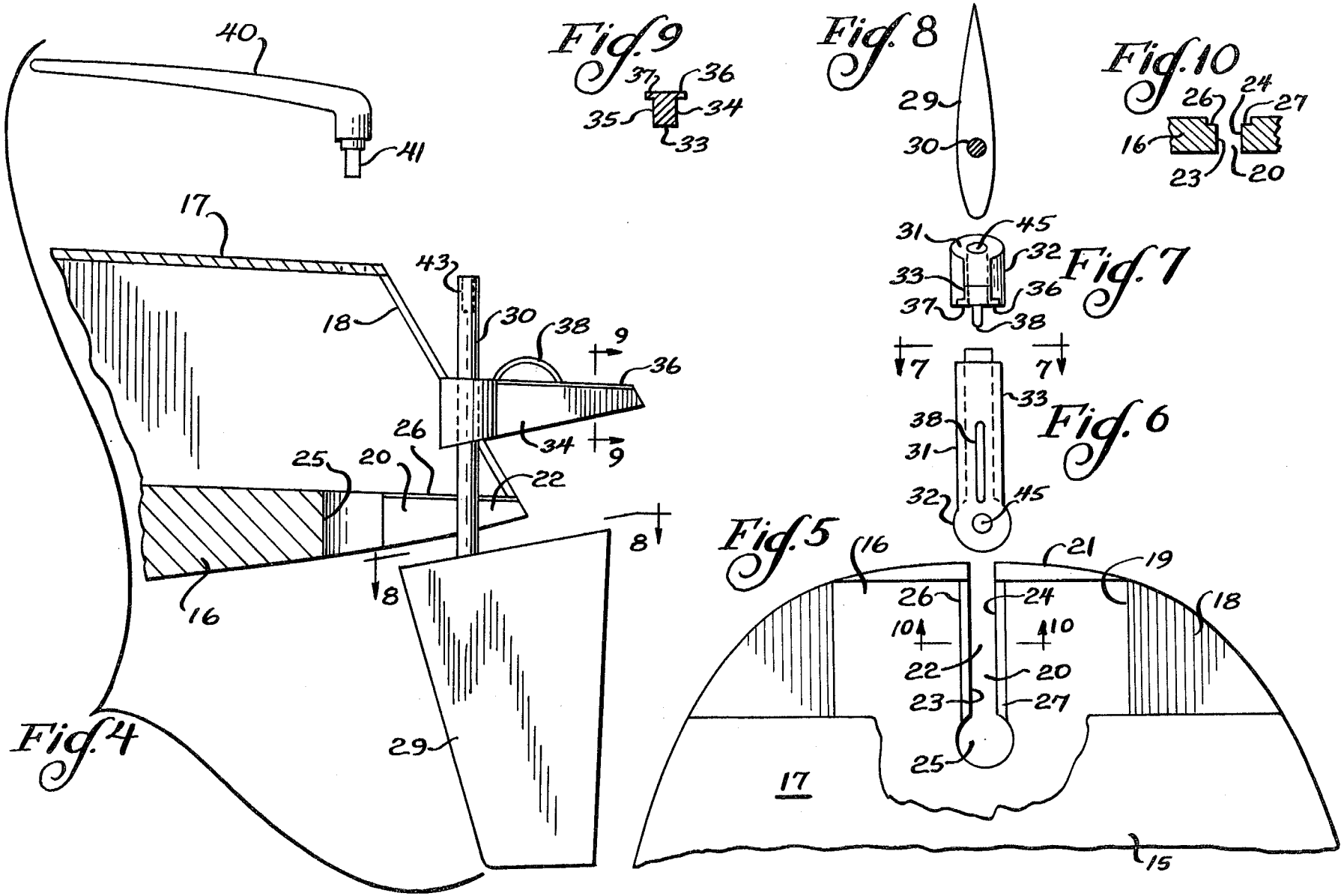
FIG. 4 is a view similar to FIGS. 1-3 showing the rudder assembly being removed.
FIG. 5 is a fragmentary top plan view of the stern of the boat with the rudder assembly removed.
FIG. 6 is a top plan view of the rudder lock member.
FIG. 7 is an end elevational view of the rudder lock member taken along the line 7—7 of FIG. 6.
FIG. 8 is a top plan view of the rudder taken along the line 8—8 of FIG. 4.
FIG. 9 is a sectional view of the rudder lock member taken along the line 9—9 of FIG. 4.
FIG. 10 is a fragmentary sectional view of the keel taken along the line 10—10 of FIG. 5.

A slot 20 (FIGS. 4 and 5) in the keel extends forwardly from the stern 21 and includes a straight rear portion 22 having parallel side walls 23 and 24 (see particularly FIG. 10) and a circular forward portion 25 which provides the slot with a key-hole shape in top plan view (FIG. 5). A pair of recesses 26 and 27 (FIGS. 5 and 10) extend laterally outwardly from the upper portions of the flat side walls to provide the rear portion of the slot with a T-shaped transverse cross section (FIG. 10).

A rudder 29 is mounted on the lower end of a cylindrical rudder shaft 30, and the rudder shaft extends through a circular opening in a rudder lock member 31. The rudder lock member has a shape corresponding to the shape of the slot in the keel and includes a cylindrical forward portion 32 (FIG. 6) and a rear portion 33. The rear portion has a pair of rearwardly extending flat parallel side walls 34 and 35 (FIG. 9) and a pair of flanges 36 and 37 which extend laterally outwardly from the upper portions of the side walls and provide the rear portion with a T-shaped cross section. A handle 30 is attached to the upper surface of the rudder lock member.

The outside diameter of the circular forward portion 32 of the rudder lock member is substantially the same as the diameter of the round portion 25 of the slot in the keel, and the lateral space between the flat side walls 34 and 35 of the rudder lock member is substantially the same as the space between the flat side surfaces 23 and 24 of the slot so that the rudder lock member fits relatively snugly in the slot. The flanges 36 and 37 of the rudder lock member are supported by the shoulders provided by the recesses 26 and 27 at the top of the slot to prevent the rudder lock member from dropping through the slot.

When the rudder assembly is installed in the boat as shown in FIG. 1, the upper end of the rudder shaft 30 terminates adjacent the deck 17, and a tiller 40 is removably attached to the rudder shaft. The tiller includes a pin 41 which extends through a circular opening 42 (FIG. 2) in the deck, and the pin extends into a counterbore 43 in the end of the rudder shaft. The peripheries of the pin and the counterbore are non-circular so that the rudder shaft and rudder can be pivoted by the tiller.

The tiller pin includes a radially enlarged base 44 which has substantially the same diameter as the opening 42 in the deck, and the base 44 acts as an upper pivot bearing for the rudder shaft. The opening 45 (FIG. 6) in the circular portion 32 of the rudder lock member acts as the lower pivot bearing. If desired, the openings 42 and 45 can be lined with low-friction bearing material. The rudder shaft is prevented from dropping downwardly through the rudder lock member 31 either by the frictional fit of the tiller pin 41 in the counterbore 43 or by a screw which extends through the rudder shaft into the tiller pin. When the rudder assembly is installed, the opening 19 (FIG. 5) in the transom can be closed by a removable panel.

The rudder assembly can be removed by following the sequence of operations illustrated in FIGS. 2-4. First, the tiller 40 is removed as shown in FIG. 2. Then the rudder lock member 31 is raised from the slot 20 in the keel by lifting the handle 38 as shown in FIG. 3. Once the rudder lock member is lifted out of the slot, the rudder shaft is free to be pulled rearwardly through the slot and out of the open end of the slot at the stern as shown in FIG. 4. The rudder does not pass vertically through the slot, and the size of the rudder is not limited by the size of the slot. The rudder assembly can be installed by following the reverse procedure.

While in the foregoing specification a detailed description of a specific embodiment of the invention was set forth for the purpose of illustration, it will be understood that many of the details hereingiven may be varied considerably by those skilled in the art without departing from the spirit and scope of the invention.

I claim:

1. A removable rudder assembly for a boat having a hull with a slot extending forwardly from the stern of the boat, the slot having an open rear end at the stern, the rudder assembly comprising a rudder lock member adapted to fit into said slot, a rudder shaft extending through an opening in said rudder lock member and being pivotable therein, a rudder attached to the lower end of the rudder shaft, and a tiller attached to the upper end of the rudder shaft, whereby the rudder and the rudder shaft can be removed from the boat by removing the rudder lock member from the slot and moving the rudder shaft rearwardly within the slot through the open rear end of the slot.

2. The rudder assembly of claim 1 in which the tiller is removably attached to the upper end of the rudder shaft.

3. The rudder assembly of claim 1 in which said rudder lock member and said slot in the hull are generally key-hole shaped in a plane extending perpendicularly to the rudder shaft.

4. The rudder assembly of claim 1 in which said rudder lock member includes a forward portion having a generally circular outer periphery and a rearward portion having a pair of generally parallel side wall portions whereby said rudder lock member has a generally key-hole shape.

5. The rudder assembly of claim 4 in which said rudder lock member includes a pair of flange portions extending laterally outwardly from the upper end of said side wall portions.

6. In a boat having a keel, a stern, and a deck, the keel having a slot extending forwardly from the stern, the slot having an open rear end at the stern and having a pair of generally parallel side wall portions extending forwardly from the stern and a cylindrical forward portion, the diameter of the cylindrical portion being greater than the distance between said side wall portions whereby said slot has a generally key-hole shape, a removable rudder assembly comprising:

(a) a rudder lock member having a forward portion having a generally circular outer periphery received in the cylindrical portion of the slot and a rearwardly extending portion having a pair of generally parallel side walls which are received between the side wall portions of the slot, (b) a rudder shaft extending through an opening in the forward portion of the rudder lock member and being pivotable therein, (c) a rudder attached to the lower end of the rudder shaft, and (d) a tiller positioned above the deck of the boat and being attached to the rudder shaft through an opening in the deck, whereby the rudder and the rudder shaft can be removed from the boat by removing the rudder lock member from the slot and moving the rudder shaft rearwardly within the slot through the open rear end of the slot.

7. The structure of claim 6 in which the tiller includes a bearing portion which is pivotally supported by the opening in the deck.

8. The structure of claim 6 in which the tiller includes a pin which extends into the upper end of the rudder shaft.

9. The rudder assembly of claim 6 in which the tiller includes a pin which extends downwardly through the opening in the deck, the pin including an end portion which extends into the upper end of the rudder shaft and a radially enlarged base portion which is pivotable within the opening in the deck.

10. The rudder assembly of claim 6 in which the slot has a pair of laterally outwardly extending recesses at the upper portions of said side wall portions and said rearwardly extending portion of the rudder lock member has a pair of flange portions extending laterally outwardly from the upper ends of the side walls thereof which are received in said recesses.

* * * * *